US007717973B2

(12) United States Patent
Oh et al.

(10) Patent No.: US 7,717,973 B2
(45) Date of Patent: May 18, 2010

(54) CYCLONE DUST-SEPARATING APPARATUS OF VACUUM CLEANER

(75) Inventors: Jang-keun Oh, Gwangju (KR); Tak-soo Kim, Gwangju (KR); Jin-gon Lee, Gwangju (KR); Young-jun Cho, Gwangju (KR)

(73) Assignee: Samsung Gwangju Elecetronics Co., Ltd., Gwangju (KR)

( * ) Notice: Subject to any disclaimer, the term of this patent is extended or adjusted under 35 U.S.C. 154(b) by 317 days.

(21) Appl. No.: 12/072,253

(22) Filed: Feb. 25, 2008

(65) Prior Publication Data

US 2009/0056290 A1 Mar. 5, 2009

Related U.S. Application Data

(60) Provisional application No. 60/967,453, filed on Sep. 5, 2007.

(30) Foreign Application Priority Data

Oct. 8, 2007 (KR) ..... 10-2007-0101101

(51) Int. Cl.
*B01D 50/00* (2006.01)

(52) U.S. Cl. ..... 55/337; 55/361; 55/368; 55/378; 55/365; 55/366; 55/428; 55/429; 55/424; 55/430; 55/431; 55/DIG. 2; 55/DIG. 3; 55/DIG. 26; 15/353; 15/352

(58) Field of Classification Search ..... 55/337, 55/361, 368, 378, 365, 366, 428, 429, 424, 55/430, 431, DIG. 2, DIG. 3, DIG. 26; 15/352, 15/353

See application file for complete search history.

(56) References Cited

U.S. PATENT DOCUMENTS

| | | | | | |
|---|---|---|---|---|---|
| 4,963,172 | A * | 10/1990 | DeMarco | ..... | 55/429 |
| 5,090,976 | A * | 2/1992 | Dyson | ..... | 55/337 |
| 5,135,552 | A * | 8/1992 | Weistra | ..... | 55/337 |
| 6,168,641 | B1 * | 1/2001 | Tuvin et al. | ..... | 55/337 |
| 6,178,590 | B1 * | 1/2001 | Lindsay et al. | ..... | 15/327.1 |

(Continued)

FOREIGN PATENT DOCUMENTS

JP 6-75352 10/1994

(Continued)

*Primary Examiner*—Jason M Greene
*Assistant Examiner*—Dung Bui
(74) *Attorney, Agent, or Firm*—Ohlandt, Greeley, Ruggiero & Perle, L.L.P.

(57) ABSTRACT

A cyclone dust-separating apparatus includes a cyclone unit having air inflow and air outflow parts that separate dust or dirt from air, the cyclone unit being installed such that a longitudinal axis thereof is substantially horizontally arranged; a dust bin joined to a bottom end of the cyclone unit that collects the dust or dirt separated by the cyclone unit, the dust bin installed in such a manner that a longitudinal axis thereof is substantially perpendicular to the longitudinal axis of the cyclone unit; a nonporous envelope detachably disposed in the dust bin that stores the dust or dirt collected into the dust bin; and a pressure difference-generating passage to communicate an outlet of the air outflow part and the dust bin with each other so as to allow the nonporous envelope to come in contact with an inner surface of the dust bin by a pressure difference between the dust bin and the air outflow part.

17 Claims, 11 Drawing Sheets

U.S. PATENT DOCUMENTS

| | | | | |
|---|---|---|---|---|
| 6,210,457 | B1 * | 4/2001 | Siemers | 55/429 |
| 6,732,405 | B2 * | 5/2004 | Oh | 15/347 |
| 7,632,327 | B2 * | 12/2009 | Yoo | 55/424 |
| 2004/0181898 | A1 * | 9/2004 | Kondo | 15/353 |
| 2005/0252179 | A1 * | 11/2005 | Oh et al. | 55/337 |
| 2007/0022564 | A1 * | 2/2007 | Witter | 15/347 |
| 2007/0028569 | A1 * | 2/2007 | Murphy | 55/337 |
| 2008/0302070 | A1 * | 12/2008 | Castronovo | 55/324 |
| 2009/0119870 | A1 * | 5/2009 | Nilsson | 15/347 |

FOREIGN PATENT DOCUMENTS

| | | |
|---|---|---|
| JP | 2003-024826 | 1/2003 |
| KR | 1020030010994 | 2/2003 |
| WO | WO9712537 | 4/1997 |
| WO | WO2004008933 | 1/2004 |

* cited by examiner

CYCLONE DUST-SEPARATING APPARATUS OF VACUUM CLEANER

CROSS-REFERENCE TO RELATED APPLICATIONS

This application claims the benefit under 35 U.S.C. §119 (a) of U.S. Provisional Patent Application No. 60/967,453, filed Sep. 5, 2007, in the United States Patent and Trademark Office, and Korean Patent Application Nos. 10-2007-0101101, filed on Oct. 8, 2007, in the Korean Intellectual Property Office, the entire contents of which are hereby incorporated by reference.

BACKGROUND OF THE INVENTION

1. Field of the Invention

The present disclosure relates to a vacuum cleaner. More particularly, the present disclosure relates to a cyclone dust-separating apparatus of a vacuum cleaner, that draws in an external air and then separates dust or dirt therefrom.

2. Description of the Related Art

In general, a cyclone dust-separating apparatus provided in a vacuum cleaner is an apparatus that whirls air laden with dirt or dust and separates the dirt or dust therefrom. Such a cyclone dust-separating apparatus usually is provided with a cyclone unit vertically and elongately installed, a cyclone body with an air inflow part and an air outflow part formed at a side and a top thereof, and a dust bin connected to a bottom part of the cyclone unit, as disclosed in U.S. Pat. No. 6,350,292. Accordingly, external air is drawn in through the side of the cyclone body and lowered while being swirled therein, and dirt or dust removed from the air is collected in the dust bin. However, the conventional cyclone dust-separating apparatus as described above requires forming the dust bin in a relatively small size because the cyclone unit has a large height. As a result, the conventional cyclone dust-separating apparatus is inconvenient to use, in that the dirt or dust collected in the dust bin should be frequently dumped.

In addition, Korean Patent No. 412,583 discloses a cyclone dust-separating apparatus of an upright cleaner, in which a dust bin is coupled to a bottom end of a cylindrical cyclone unit, the diameter of the dust bin being equal to that of the cylindrical cyclone unit. External air drawn into the cyclone unit through a side of the cyclone unit is whirled while lowering within an internal space of the dust bin as well as within an internal space of the cyclone unit. Accordingly, such a conventional cyclone dust-separating apparatus is disadvantageous in that because the cyclone unit is vertically arranged, the capacity of the dust bin is relatively small. Furthermore, there is a problem in that because the air whirling within the cyclone unit is lowered to the internal space of the dust bin, the dust stored within the dust bin is entrained by the swirling air and flows backward to the cyclone unit.

Also, the cyclone dust-separating apparatuses of U.S. Pat. No. 6,350,292 and Korean Patent No. 412,583 are advantageous in that they can be semi-permanently used without any inconvenience of frequently replacing dust bags as in the conventional general dust-collecting apparatus, but disadvantageous in that since the dust or dirt is collected and stored in the dust bin, a scattering of the dust or dirt and/or a contamination of circumference according thereto are generated when the dust or dirt collected in the dust bin is dumped.

SUMMARY OF THE INVENTION

An aspect of the present disclosure is to address at least the above problems and/or disadvantages and to provide at least the advantages described below. Accordingly, an aspect of the present disclosure is to provide a cyclone dust-separating apparatus having a dust bin, the volume of which is increased as compared with other cyclone dust-separating apparatuses of the same height.

Another aspect of the present disclosure is to provide a cyclone dust-separating apparatus in which dirt or dust collected in the dust bin is prevented from flowing backward.

Further another aspect of the present disclosure is to provide a cyclone dust-separating apparatus that prevents the dirt or dust collected in the dust bin from scattering and/or contaminating a circumference due to the scattering of the dust or dirt when the dirt or dust collected in the dust bin is dumped.

In accordance with an aspect of the present disclosure, a cyclone dust-separating apparatus includes a cyclone unit having an air inflow part and an air outflow part so as to separate dust or dirt from air, the cyclone unit being installed in such a manner that a longitudinal axis thereof is substantially horizontally arranged; a dust bin joined to a bottom end of the cyclone unit so as to collect the dust or dirt separated by the cyclone unit, the dust bin being installed in such a manner that a longitudinal axis thereof is substantially perpendicular to the longitudinal axis of the cyclone unit; a nonporous envelope detachably disposed in the dust bin so as to store the dust or dirt collected into the dust bin; and a pressure difference-generating passage to communicate an outlet of the air outflow part and the dust bin with each other so as to allow the nonporous envelope to come in contact with an inner surface of the dust bin by a pressure difference between the dust bin and the air outflow part.

The dust bin may include an air discharging passage connected with the air outflow part, so that the air discharged from the cyclone unit penetrates through the dust bin and discharges in a direction toward a bottom end of the dust bin, and the pressure difference-generating passage may include a plurality of openings formed in the dust bin so as to allow the dust bin to communicate with the air discharging passage. Here, the air discharging passage may be disposed to penetrate through a dust bin chamber of the dust bin in upward and downward directions. Particularly, the air discharging passage may be formed on one side of the dust bin chamber, so that a width of air path thereof is gradually enlarged from an upper part to a lower part thereof.

Also, the cyclone dust-separating apparatus may further include a filter unit joined to the bottom end of the dust bin so as to filter dust or dirt included in the air discharged through the air discharging passage from the cyclone unit. Here, preferably, but not necessarily, the filter unit includes a filter cover joined to the bottom end of the dust bin to form a filter chamber in a predetermined volume, and a filter member disposed in the filter chamber. In this case, the filter member may include a pleated cylindrical filter, an upper part of which is blocked.

In accordance with another aspect of the present disclosure, the dust bin may include an outer tub, and an inner tub disposed in a spaced-apart relation to the outer tub so as to form an air flowing space between the outer tub and the inner tub, the inner tube at an upper part thereof being joined with the outer tub, and the pressure difference-generating passage may include a subsidiary passage disposed between the air outflow part of the cyclone unit and the outer tub so as to communicate between the air outflow part and the air flowing space, and a plurality of openings formed in the inner tub of the dust bin so as to allow the inner tub of the dust bin to communicate with the subsidiary passage through the air flowing space.

In accordance with further another aspect of the present disclosure, the cyclone dust-separating apparatus may further include an air discharging passage connected with the air outflow part, so that the air discharged from the cyclone unit is flowed in a direction toward a bottom end of the dust bin along an outside of the dust bin and then discharged, and the pressure difference-generating passage may include a plurality of openings formed in the dust bin so as to allow the dust bin to communicate with the air discharging passage.

A close up-switching part may be disposed to the pressure difference-generating passage so as to close up the plurality of openings when the nonporous envelope is not used. The close up-switching part may include a rotating plate rotatably disposed to the dust bin and having a plurality of homologous openings corresponding to the plurality of openings, and a knob formed on the rotating plate so as to rotate the rotating plate.

Also, the cyclone dust-separating apparatus may further include a filter unit joined to the bottom end of the dust bin so as to filter dust or dirt included in the air discharged through the air discharging passage from the cyclone unit. Here, preferably, but not necessarily, the filter unit includes a filter cover joined to the bottom end of the dust bin to form a filter chamber in a predetermined volume, and a filter member disposed in the filter chamber. In this case, the filter member may include a porous filter fixed on a filter mount of the filter cover.

BRIEF DESCRIPTION OF THE DRAWINGS

The above and other objects, features, and advantages of certain exemplary embodiments of the present disclosure will be more apparent from the following description taken in conjunction with the accompanying drawings, in which.

Throughout the drawings, the same reference numerals will be understood to refer to the same elements, features, and structures.

DETAILED DESCRIPTION OF THE EXEMPLARY EMBODIMENTS

Hereinafter, certain exemplary embodiments of the present disclosure will be described in detail with reference to the accompanying drawing figures.

Figure 1:
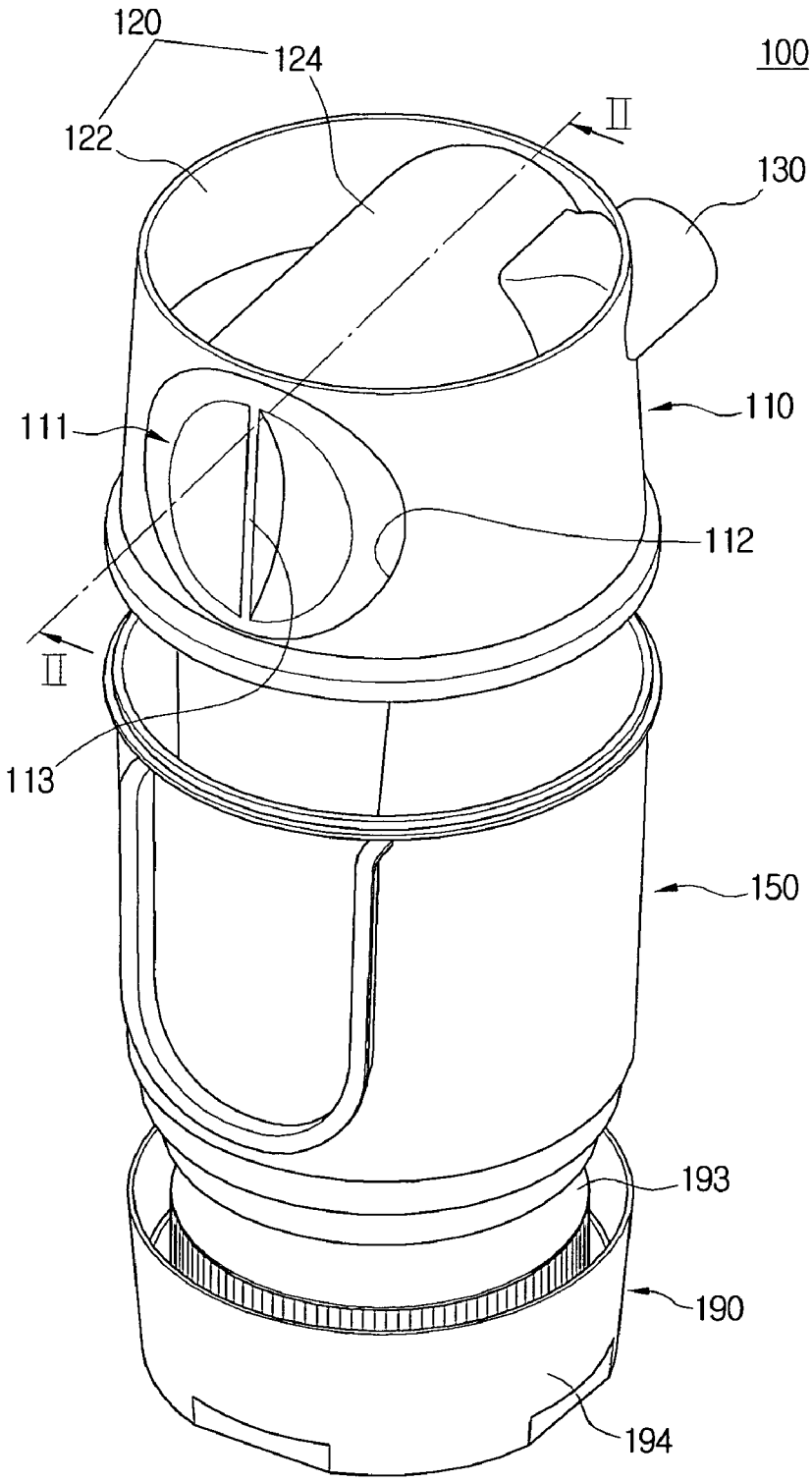
FIG. 1 is an exploded perspective view exemplifying a cyclone dust-separating apparatus of a vacuum cleaner.
Figure 2:
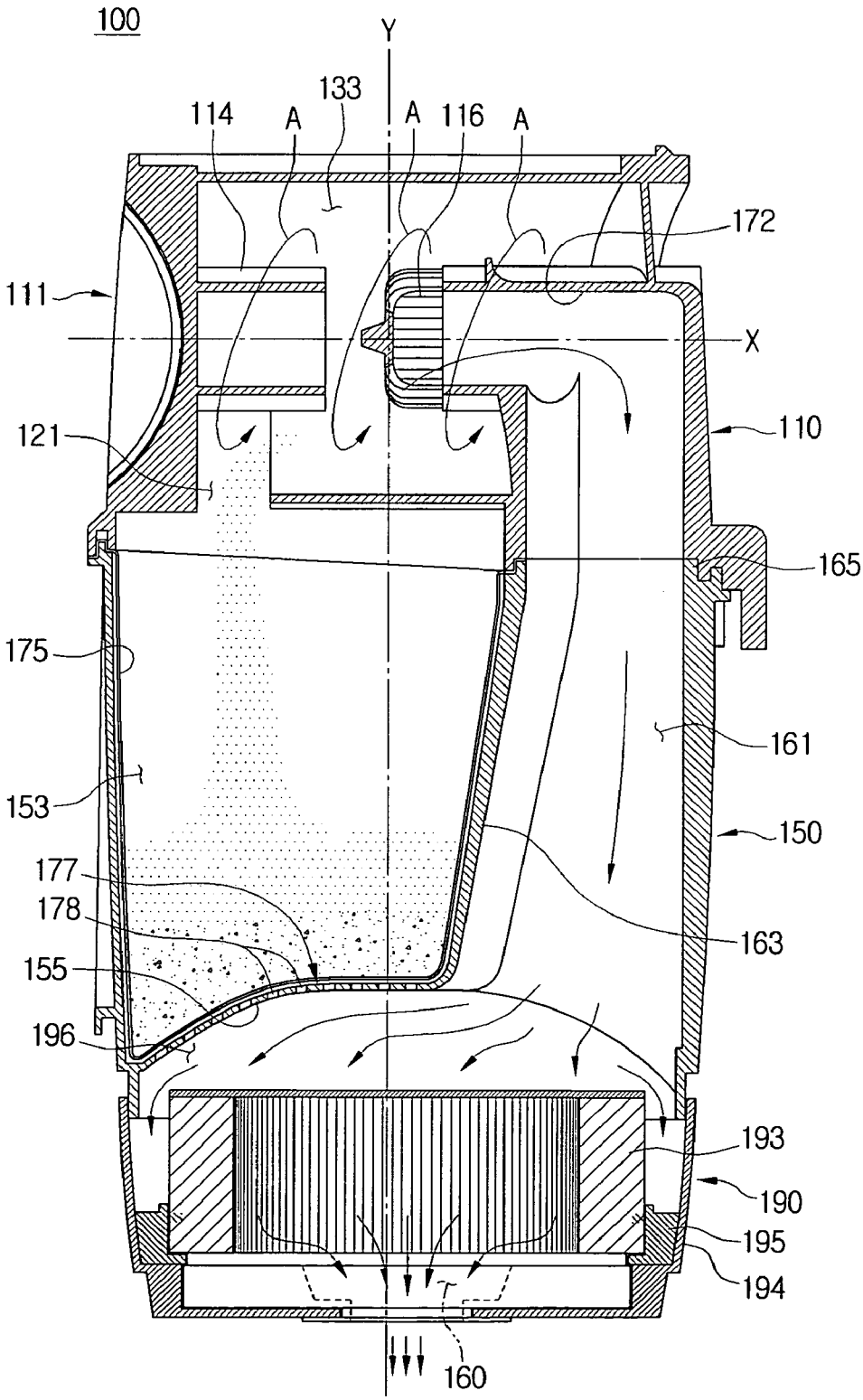
FIG. 2 is a cross-sectional view of the cyclone dust-separating apparatus taken along line II-II of FIG. 1.

FIGS. 1 and 2 are a perspective view and a cross-sectional view schematically exemplifying a cyclone dust-separating apparatus of a vacuum cleaner.

Referring to FIGS. 1 and 2, the cyclone dust-separating apparatus 100 includes a cyclone unit 110, a dust bin 150, a nonporous envelope 175, a pressure difference-generating passage 177 and a filter unit 190.

The cyclone unit 110 is provided with a cyclone body 120, a guide unit 111 detachably disposed on a side surface of the cyclone body 120, a filter 116, an outflow pipe 172, and an inflow pipe 130.

The cyclone body 120 has an outer body 122 and an inner body 124. The inner body 124 is formed in a laid cylinder shape arranged in such a manner that its longitudinal axis X extends substantially in the horizontal direction, as explained in the cyclone body 124, and the outer body 122 is formed in a stand-up cylinder shape arranged in such a manner that its longitudinal axis Y extends substantially in the vertical direction.

The guide unit 111 is mounted in a mounting opening 112 formed on one side surface of the outer body 122 of the cyclone body 120. The guide unit 111 has a knob 112 and a guide pipe 114. A handle 113 is projected from a center of the knob 212 so as to be capable of being gripped by a user. The guide pipe 114 is connected to a side of the knob 112 and installed to project into the inside of the inner body 124 of the cyclone body 120.

The filter 116 is removably mounted on an end of the outflow pipe 172, and air drawn in into the inside of the cyclone body 120 is discharged to the outside via the outflow pipe 172 after separating dirt or dust therefrom through the filter 116. In the present embodiment, the filter 116 is formed of a grill member with a plurality of through-holes. In the cyclone unit 110, the guide pipe 114 and the outflow pipe 172 are substantially horizontally arranged.

As illustrated in FIG. 2, the outflow pipe 172 is formed in an inverted L-shape. On one end of the outflow pipe 172 is installed the filter 116, and to the other end of the outflow pipe 172 is connected an air discharging passage 161 formed in the dust bin 150. Accordingly, after whirling within a cyclone chamber 133, air passes through the filter 116 and discharges through the air discharging passage 161 of the dust bin 150 via the outflow pipe 172.

The air discharging passage 161 is formed to penetrate through the dust collecting chamber 153 of the dust bin 150 in upward and downward directions at a side of the dust collecting chamber 153, and is connected with the outflow pipe 172, so that the air discharged from the outflow pipe 172 of the cyclone unit 110 penetrates through the dust bin 150 and discharges in a direction toward a bottom end of the dust bin 150. Here, the air discharging passage 161 may be formed, so that a width of air path thereof is gradually enlarged from an upper part to a lower part thereof. The air discharging passage 161 can be formed in a pipe shape, that is, substantially round in cross-section, but is not limited thereto. A top end of the air discharging passage 161 joined with the outflow pipe 172 has the same inner diameter as that of the outflow pipe 172. The outflow pipe 172 is configured, so that its lower part has an inner diameter gradually enlarged to become larger than that of its upper part, thereby allowing its bottom end to have the largest passage width. Accordingly, the more the air gets near to the bottom end of outflow pipe 172, the more the flow speed of the air is reduced.

The inflow pipe 130 through which external air is flowed in penetrates through the outer body 122 of the cyclone body 120 and is connected to the inner body 124.

The dust bin 150 has a very large volume as compared with that of the cyclone unit 110 and is vertically arranged, so that a Y-axis is a longitudinal axis thereof and thus the longitudinal axis thereof is perpendicular or substantially perpendicular to the longitudinal axis X of the cyclone unit 110.

The dust bin 50 is divided into the dust collecting chamber 153 and the air discharging passage 161 by a partition 163. A bottom surface 155 of the dust bin 150 is formed to bulge toward the dust collecting chamber 153 and the air discharging passage 161.

The nonporous envelope 175, which stores the dust or dirt collected into the dust bin 150, is detachably disposed in the dust collecting chamber 153 of the dust bin 150. That is, the nonporous envelope 175 is disposed, so that a top part thereof is interposed between the dust bin 150 and the cyclone body 120 when the dust bin 150 is coupled with the cyclone body 120 by a known cam lifting unit (not illustrated), which is installed under the dust-separating apparatus 100 to lift and lower the dust bin 150. Preferably, but not necessarily, the nonporous envelope 175 is made of vinyl.

The pressure difference-generating passage 177 communicates the dust collecting chamber 153 with a filter chamber 196 of the filter unit 190 and the air discharging passage 161 connected with the outflow pipe 172 so as to allow the nonporous envelope 175 to come in contact with an inner surface of the dust collecting chamber 153 of the dust bin 150 by a pressure difference between the dust collecting chamber 153 and the filter chamber 196/the air discharging passage 161. For this, the pressure difference-generating passage 177 is provided with a plurality of openings 178. The plurality of openings 178 is formed in the bottom surface 155 of the dust bin 155, so that the dust collecting chamber 153 is directly communicated with the filter chamber 196/the air discharging passage 161. The plurality of openings 178 may be formed in the partition 163, instead of or in addition to the bottom surface 155.

Accordingly, when the air is drawn in by a suction motor (not illustrated) of the vacuum cleaner, a pressure difference is generated between the dust collecting chamber 153 and the filter chamber 196/the air discharging passage 161 because the dust collecting chamber 153 is in fluid communication with the filter chamber 196 and the air discharging passage 161 through the plurality of openings 178. At this time, the filter chamber 196 and the air discharging passage 161 have a pressure lower than that of the dust collecting chamber 153. As a result, the nonporous envelope 175 is adhered closely to the inner surface of the dust collecting chamber 153.

The filter unit 190 is joined to a bottom end of the dust bin 150, and includes a filter cover 194 and a filter member 193. The filter cover 194 is detachably locked and fixed to the bottom end of the dust bin 150 and forms the filter chamber 196 of predetermined volume therein. In addition, the filter cover 194 at a bottom surface thereof is formed an opening 160 through which the air past the filter member 193 is discharged. The opening 160 is connected directly or indirectly with the suction motor of the vacuum cleaner.

The filter chamber 193, as a pleated cylindrical filter, the upper part of which is blocked and the lower part of which is opened, is vertically installed in the filter mount 195 of the filter chamber 196.

As described above, the cyclone dust-separating apparatus 100 is configured so that the inner body 124 of the cyclone body 120 is formed to have the longitudinal axis X horizontally arranged and the dust bin 150 is formed to have the longitudinal axis Y vertically arranged. Accordingly, a size of the dust bin 150 can be increased as compared with other cyclone dust-separating apparatuses of the same height. Thus, the cyclone dust-separating apparatus according to the first exemplary embodiments of the present disclosure can increase the capacity of the dust bin 150, thereby improving the convenience in use.

Further, since the air whirls on the horizontally arranged longitudinal axis X within the cyclone unit 110, the dust or dirt stored in the nonporous envelope 175 of the dust collecting chamber 153 vertically arranged scarcely flows backward to the cyclone unit 110 again.

Furthermore, to empty the dust bin 150 of the dust or dirt collected therein, only the nonporous envelope 175 is separated from the dust bin 150 and dumped. Accordingly, a scattering of the dust or dirt and/or a contamination of circumference according to that is prevented.

Also, the air discharging passage 161 discharging the air from the cyclone chamber 133 is configured to pass through the dust bin 150, thereby reducing the piping loss of the discharged air.

Now, an operation of the cyclone dust-separating apparatus 100 will be explained in detail with reference to FIGS. 1 and 2.

First, if the suction motor of the vacuum cleaner is operated, external air is drawn into the cyclone chamber 133 through the inflow pipe 130. The dawn-in air drops dust or dirt into the dust collecting chamber 153 of the dust bin 150 joined to the bottom end of the cyclone chamber 133 through a dirt discharge port 121 while whirling as indicated by arrows A in FIG. 2.

With a suction force, the air from which the dust or dirt is removed as described above passes through the filter 116, and bends its flow from a horizontal direction to a vertical-and-down direction while passing through the outflow pipe 172. While the air passes through the air discharging passage 161 formed on the side of the dust bin 150, the flow speed of the air is slowed down. When the air reaches the filter chamber 196, the flow speed of the air goes down abruptly.

At this time, since the dust collecting chamber 153 of the dust bin 150 is communicated with the air discharging passage 161 through the plurality of openings 178, a pressure difference is generated between the dust collecting chamber 153 and the filter chamber 196/the air discharging passage 161. As a result, the nonporous envelope 175 is adhered closely to the inner surface of the dust collecting chamber 153.

The air flowed into the filter chamber 196 passes in a slow speed through the filter member 193 disposed in the filter chamber 196, and thus fine dust remained in the air is collected by the filter member 193. And then, the fine dust-removed air is discharged to the outside of the cyclone dust-separating apparatus 100 through the opening 160 formed in the filter cover 194.

When the nonporous envelope 175 of the dust bin 150 is filled with the dust or dirt by the operation of the dust-separating apparatus 10 as described above, the dust bin 150 is separated from the cyclone body 120 of the cyclone unit 110 by the cam lifting unit. And then, to empty the dust bin 150 of the dust or dirt collected therein, a user need only separate nonporous envelope 175 from the dust bin 150 and dump the dust or dirt. Thus, the dust bin 150 can be simply emptied.

FIGS. 3 through 7 are a side elevation, a perspective view and cross-sectional views exemplifying a cyclone dust-separating apparatus of a vacuum cleaner according to a second exemplary embodiment of the present disclosure.

As illustrated in FIGS. 3 through 7, the cyclone dust-separating apparatus 200 includes a cyclone unit 210, a dust bin 250, a nonporous envelope 275, and a pressure difference-generating passage 277.

Figure 4:
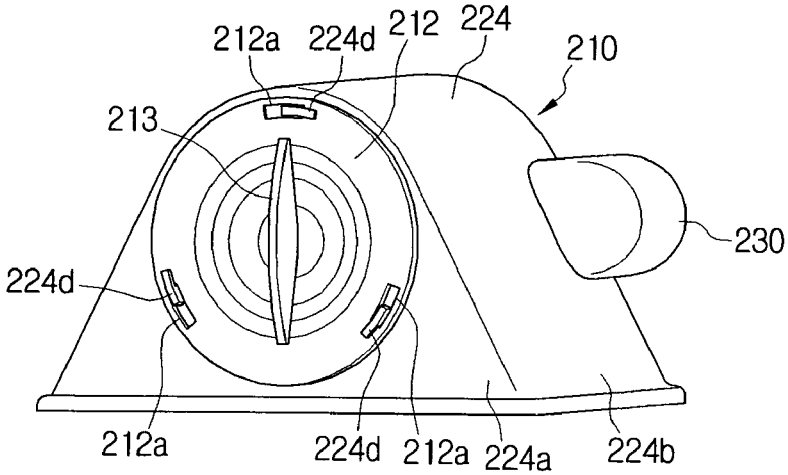
FIG. 4 is a perspective view exemplifying only a cyclone unit of the cyclone dust-separating apparatus illustrated in FIG. 3.
Figure 5:
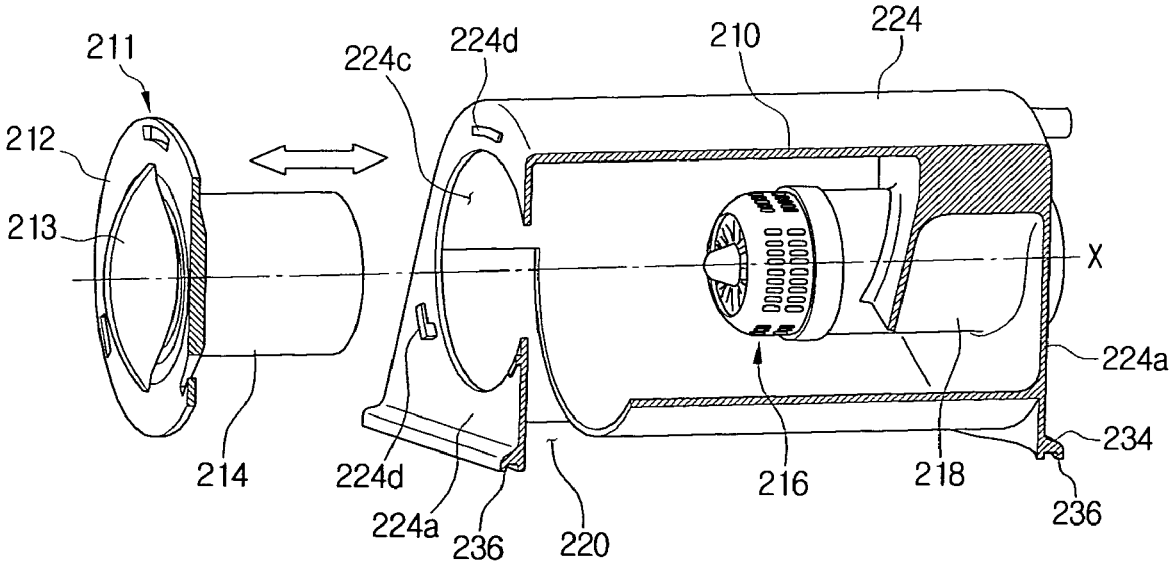
FIG. 5 is a partially cut-away and exploded perspective view of the cyclone unit of the cyclone dust-separating apparatus illustrated in FIG. 3.

Referring to FIGS. 4 and 5, the cyclone unit 210 includes a cyclone body 224, a guide unit 211, a filter 216, an outflow pipe 218 and an inflow pipe 230. In addition, the cyclone unit 210 horizontally extends, so that air is horizontally drawn thereinto and horizontally discharged therefrom. That is, the cyclone unit 210 is arranged in such a manner that its longitudinal axis X extends substantially in the horizontal direction, as illustrated in FIG. 5.

The cyclone body 224 is made up of opposite side walls 224*a*, each of which is formed in a triangular shape with a rounded top apex, and a body part 224*b* interconnecting the side walls 224*a*. One side wall 224*a* is provided with a mounting opening 224*c*, in which the guide unit 211 is mounted, and the other side wall 224*a* is provided with the outflow pipe 218, which extends into the inside of the cyclone body 224 and through which clean air can be discharged. Because the outflow pipe 218 extends parallel to the X-axis in the horizontal direction, an air outlet 226 (see FIG. 6) through which the air is discharged is also formed in the horizontal direction. In addition, an inflow pipe 230, through which external air is drawn in, is projected from the body part 224*b*. The cyclone body 224 has an extended part 234 extended around a lower end thereof to form an elongated groove 236 into which a top end of the dust bin 250 can be inserted. A sealing member (not shown) is inserted into the elongated groove 236 so as to seal a gap between the dust bin 250 and the cyclone body 224. A dirt discharge port 220 is formed at a side of the cyclone body 224, so that internal spaces of the cyclone body 224 and the dust bin 250 are communicated with each other and thus dirt or dust separated from the air drops into the dust bin 250. The dirt discharge port 220 is formed in the circumferential direction of the body part 224*b* of the cyclone body 224 below a guide pipe 214.

The guide unit 211 is mounted in the mounting opening 224*c* formed through one of the side walls 224*a* of the cyclone body 224. The guide unit 211 has a knob 212 and a guide pipe 214, wherein three locking holes 212*a* are formed in the knob 212 in the circumferential direction of the knob 212 and a handle 213 is projected from the center of the knob 212 so as to be capable of being gripped by a user. Locking projections 224*d* projecting from the side wall 224*a* of the cyclone body 224 are inserted into the locking holes 212*a*, respectively, so that the guide unit 211 is fixed to the cyclone body 224. The guide pipe 214 is connected to a side of the knob 212 and extends into the inside of the cyclone body 224. The guide unit 211 can be mounted in or removed from the cyclone body 224 merely by rotating the handle 213 of the knob 212.

The filter 216 is removably mounted on an end of the outflow pipe 218, and air drawn in into the inside of the cyclone body 224 is discharged to the outside via the filter 216 and the outflow pipe 218 after separating dirt or dust therefrom. In the present embodiment, the filter 216 is formed of a grill member with a plurality of through-holes. In the cyclone unit 210, the guide pipe 214 and the outflow pipe 218 are substantially horizontally arranged.

Figure 6:
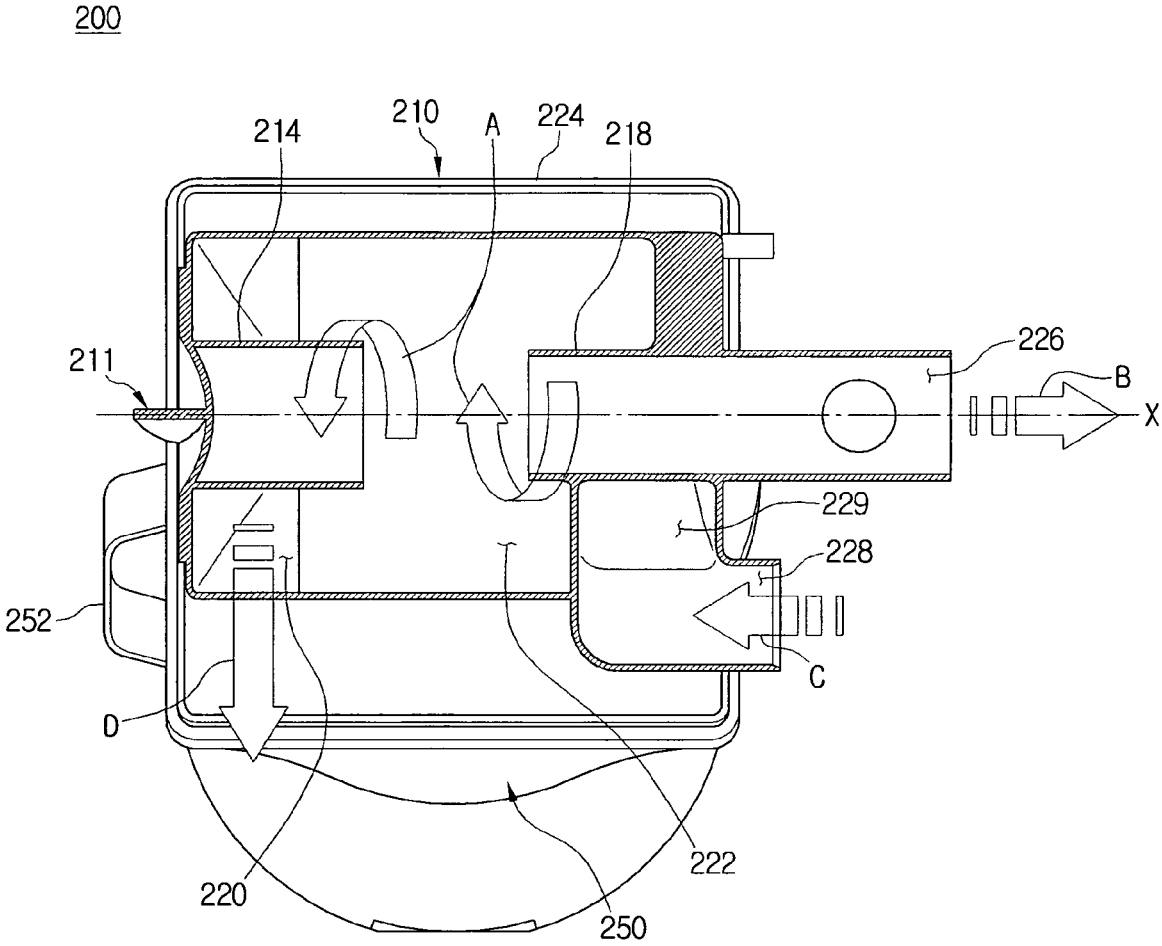
FIG. 6 is a cross-sectional view of the cyclone dust-separating apparatus taken along line VI-VI of FIG. 3.

As illustrated in FIGS. 4 and 6, the inflow pipe 230, as an air inflow part, is provided on the cyclone body 224 in the same direction as that of the outflow pipe 218 and is projected from a side of the body part of the cyclone body 224 in such a manner that an air inlet 228 through which air is drawn in is formed in the horizontal direction. As illustrated in FIG. 6, the inflow pipe 230 is formed in an inverted L-shape.

Figure 3:
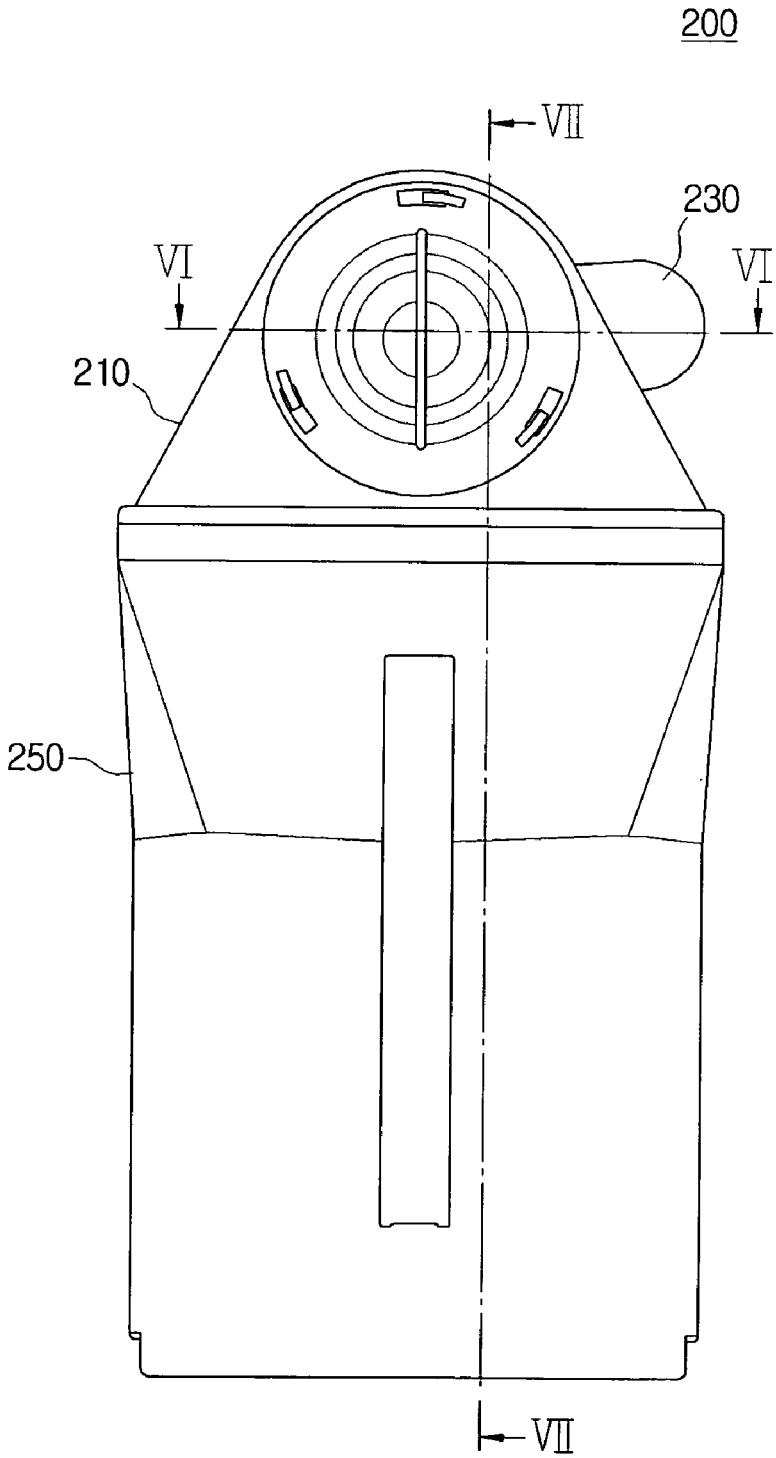
FIG. 3 is a side elevation exemplifying a cyclone dust-separating apparatus of a vacuum cleaner.
Figure 7:
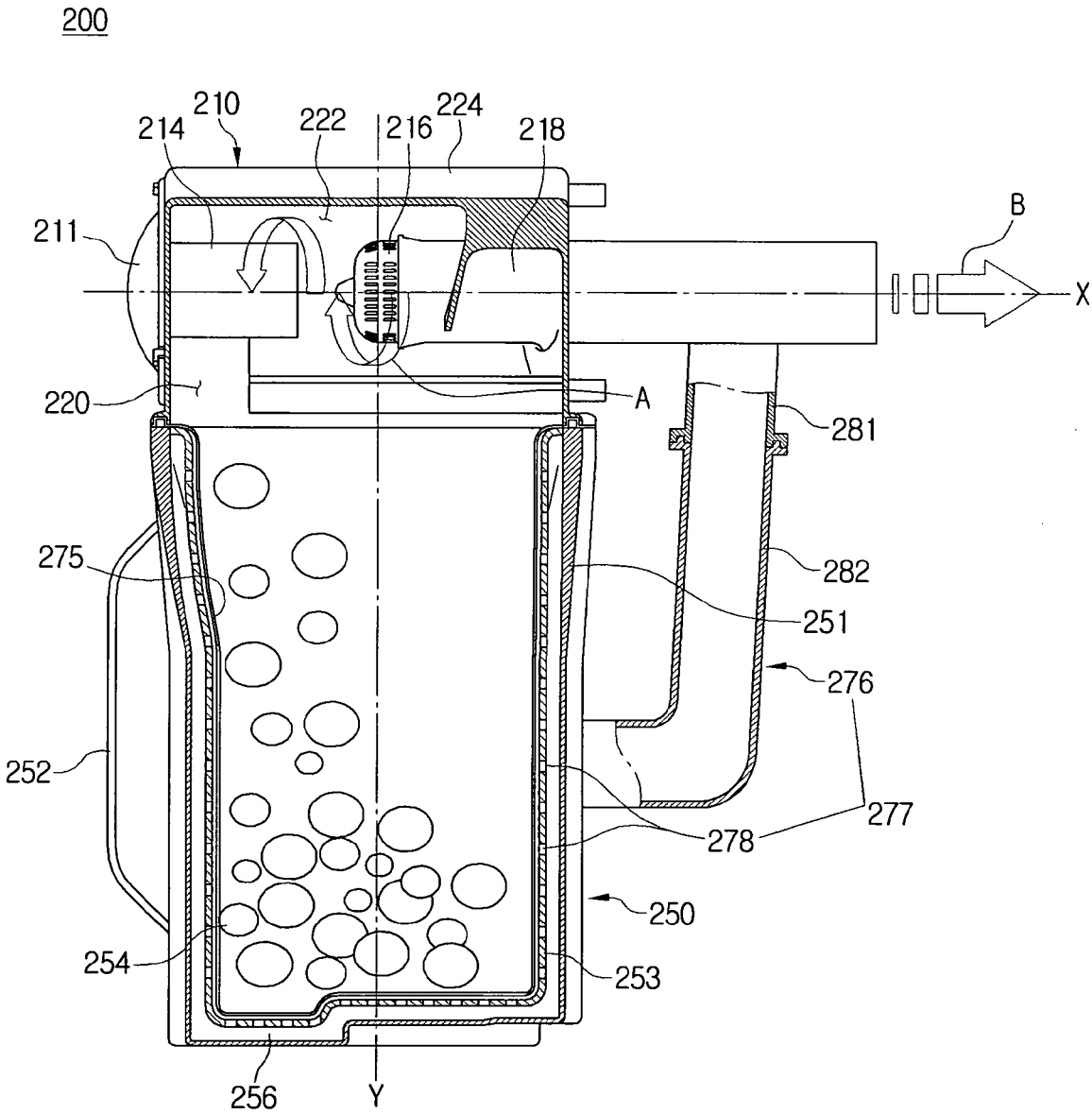
FIG. 7 is a cross-sectional view of the cyclone dust-separating apparatus taken along line VII-VII of FIG. 3.
Figure 8:
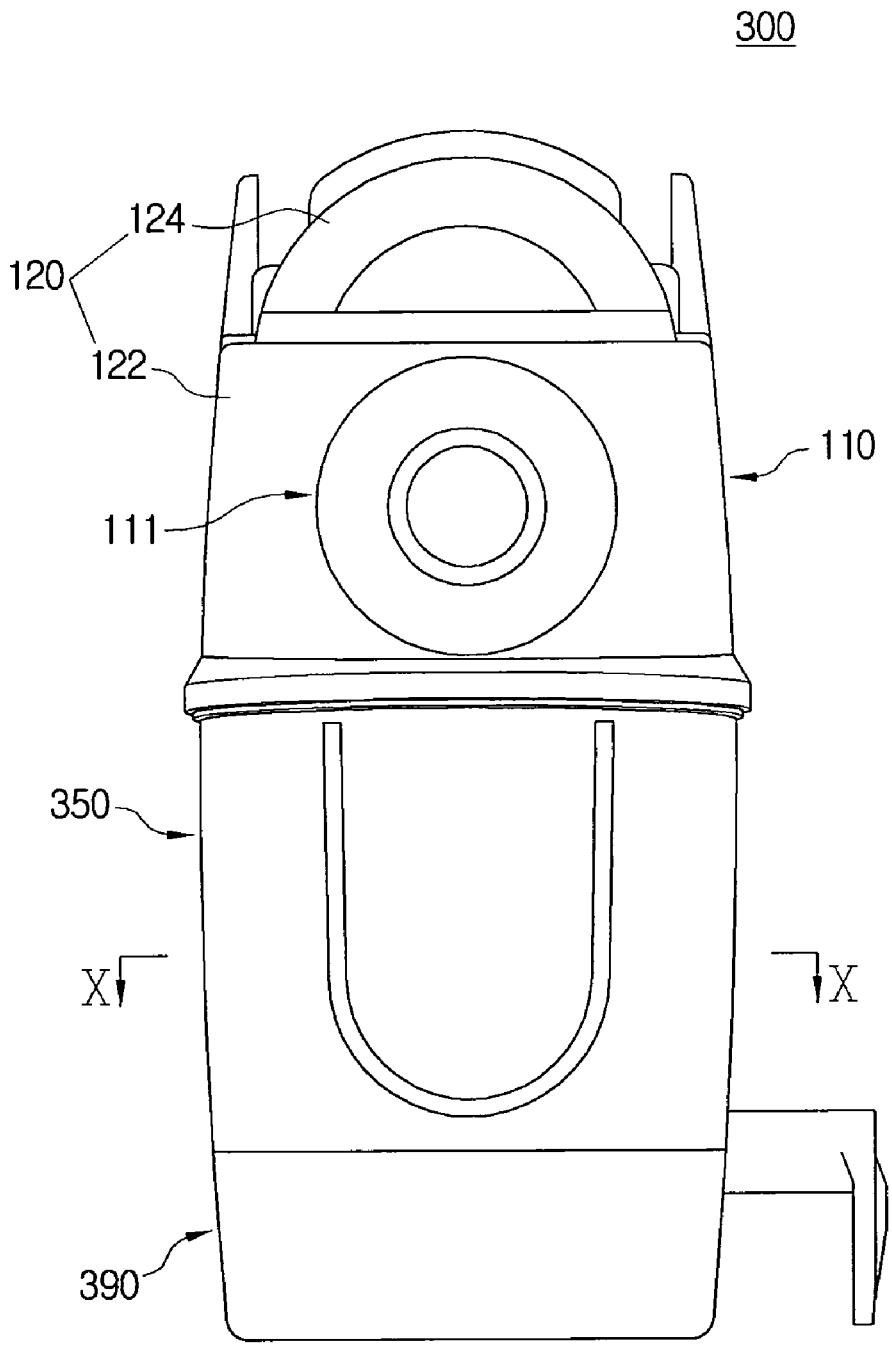
FIG. 8 is a side elevation exemplifying a cyclone dust-separating apparatus of a vacuum cleaner.

Referring to FIGS. 3 and 7, the dust bin 250 has a very large volume as compared with that of the cyclone unit 210 and is vertically arranged, so that axis Y is a longitudinal axis thereof and thus the longitudinal axis thereof is perpendicular or substantially perpendicular to the longitudinal axis of the cyclone unit 210. The dust bin 250 has an outer tub 251, and an inner tub 253 disposed in a spaced-apart relation to the outer tub 251 so as to form an air flowing space 256 between the outer tub 251 and the inner tub 253. The inner tube 253 at an upper part thereof is joined with the outer tub 251. In addition, the dust bin 250 is removably coupled to a bottom end of the cyclone unit 210 and has a handle 252 at a side thereof, so that a user grips the dust bin 250 thus to mount or remove it. Also, the dust bin 250 at a top end thereof is inserted into the elongated groove 236 formed on the bottom end of the cyclone body 224.

The nonporous envelope 275, which stores the dust or dirt collected into the dust bin 250, is detachably disposed in the inner tub 253 of the dust bin 250. That is, the nonporous envelope 275 is disposed, so that a top part thereof is interposed between the dust bin 250 and the cyclone body 224 when the dust bin 250 is assembled with the cyclone body 224, like the nonporous envelope 175 of FIG. 2. Preferably, but not necessarily, the nonporous envelope 275 is made of vinyl.

As illustrated in FIG. 7, the pressure difference-generating passage 277 is in communication with the dust bin 250 with the outflow pipe 218 so as to allow the nonporous envelope 275 to come in contact with an inner surface of the inner tub 253 of the dust bin 250 by a pressure difference between the outflow pipe 218 and the dust bin 250. For this, the pressure difference-generating passage 277 is provided with a subsidiary passage 276 and a plurality of openings 278. The subsidiary passage 276 is disposed to connect between the outflow pipe 218 of the cyclone unit 210 and the outer tub 251 so as to communicate between the outflow pipe 218 and the air flowing space 256. The subsidiary passage 276 is made up of a first connecting pipe 281 connected with the outflow pipe 218 and a second connecting pipe 282 connected to the outer tub 251. The first and the second connecting pipes 281 and 282 are detachably coupled to each other. The plurality of openings 278 is formed in the inner tub 253 of the dust bin 250, so that the inner tub 253 of the dust bin 250 is in direct communication with the subsidiary passage 276 through the air flowing space 256.

Accordingly, when air is drawn in by a suction source (not illustrated), a pressure difference is generated between the inner tub 253 and the subsidiary passage 276 because the inner tub 253 is communicated with the subsidiary passage 276 through the plurality of openings 278. As a result, the nonporous envelope 275 installed in the inner tub 253 of the dust bin 250 is adhered closely to the inner surface of the inner tub 253.

Hereinafter, an operation of the cyclone dust-separating apparatus 200 will be described in detail with reference to FIGS. 6 and 7.

Referring to FIGS. 6 and 7, external air is drawn in through the air inlet 228 of the inflow pipe 230 projecting from the side of the cyclone body 224, as indicated by arrow C in FIG. 6.

The air flows along the inflow pipe 230 and a bent air flow passage 229 within the cyclone body 224 and moves toward the guide pipe 214 while whirling around the outflow pipe 218, as indicated by arrows A in FIG. 6. The guide pipe 214 serves to prevent the air from being dispersed from the center of rotation. Dust or dirt 254 suspended in the air drops to the dust bin 250 through the dirt discharge port 220 as indicated by arrow D.

FIG. 7 illustrates the dust or dirt 254 dropping to the dust bin 250. Although dust or dirt 254, which is heavier than the air, thereby being subjected to higher centrifugal force, drops to the dust bin 250, the air is turned toward the filter 216 by a suction force transferred through the outflow pipe 218 and dust or dirt 254, which has not yet removed from the air, is separated from the air while the air is passing through the filter 216. And then, the air is discharged toward the vacuum motor of the vacuum cleaner through the outflow pipe 218 and the air outlet 226.

At this time, because the whirling air stream formed in the cyclone chamber 222 is not transferred to the dust bin 250, the dust or dirt 254 dropped into the dust bin 250 through the dirt discharge port 220 substantially does not flow backward to the cyclone unit 210.

In addition, because the cyclone unit 210 is arranged horizontally as illustrated in FIG. 7, it is possible to reduce the entire height of the cyclone dust-separating apparatus 200. Accordingly, if the cyclone dust-separating apparatus is configured in the same height as the conventional cyclone dust-separating apparatus with the vertical cyclone unit, the volume of the dust bin 250 can be substantially increased as compared to that of the conventional one, whereby a period for emptying the dust bin 250 can be greatly increased.

If the user wants to dump the dust or dirt collected in the dust bin 250, she or he grips the handle 252 provided on the dust bin 250 and removes the dust bin 250 from the cyclone unit 210. And then, to empty the dust bin 250 of the dust or dirt collected therein, the nonporous envelope 275 is separated from the dust bin 250 and dumped.

In addition, if the user wants to clean the filter 216 of the cyclone unit 210 or the inside of the cyclone chamber 222, she or he removes the filter 216 from the outflow pipe 218 so as to clean the filter 216 or cleans the cyclone chamber 222 through the mounting opening 224*c* formed on the cyclone body 224, after removing the guide unit 211 from the cyclone body 24.

FIGS. 8 through 10B are a side elevation, an exploded perspective view, and cross-sectional views exemplifying a cyclone dust-separating apparatus 300.

Referring to FIGS. 8 through 10B, the cyclone dust-separating apparatus 300 includes a cyclone unit 110, a dust bin 350, a nonporous envelope 175, a pressure difference-generating passage 377, and a filter unit 390. Because constructions of the cyclone unit 10 and the nonporous envelope 175 are the same as those of the cyclone dust-separating apparatus 100 as described above with reference to FIGS. 1 and 2, a detailed description thereof will be omitted for clarity and conciseness.

Unlike the dust bin 150 of the cyclone dust-separating apparatus 100, the dust bin 350 is formed in a cylindrical shape outside an outer circumferential surface of an air discharging passage 361.

Figure 9:
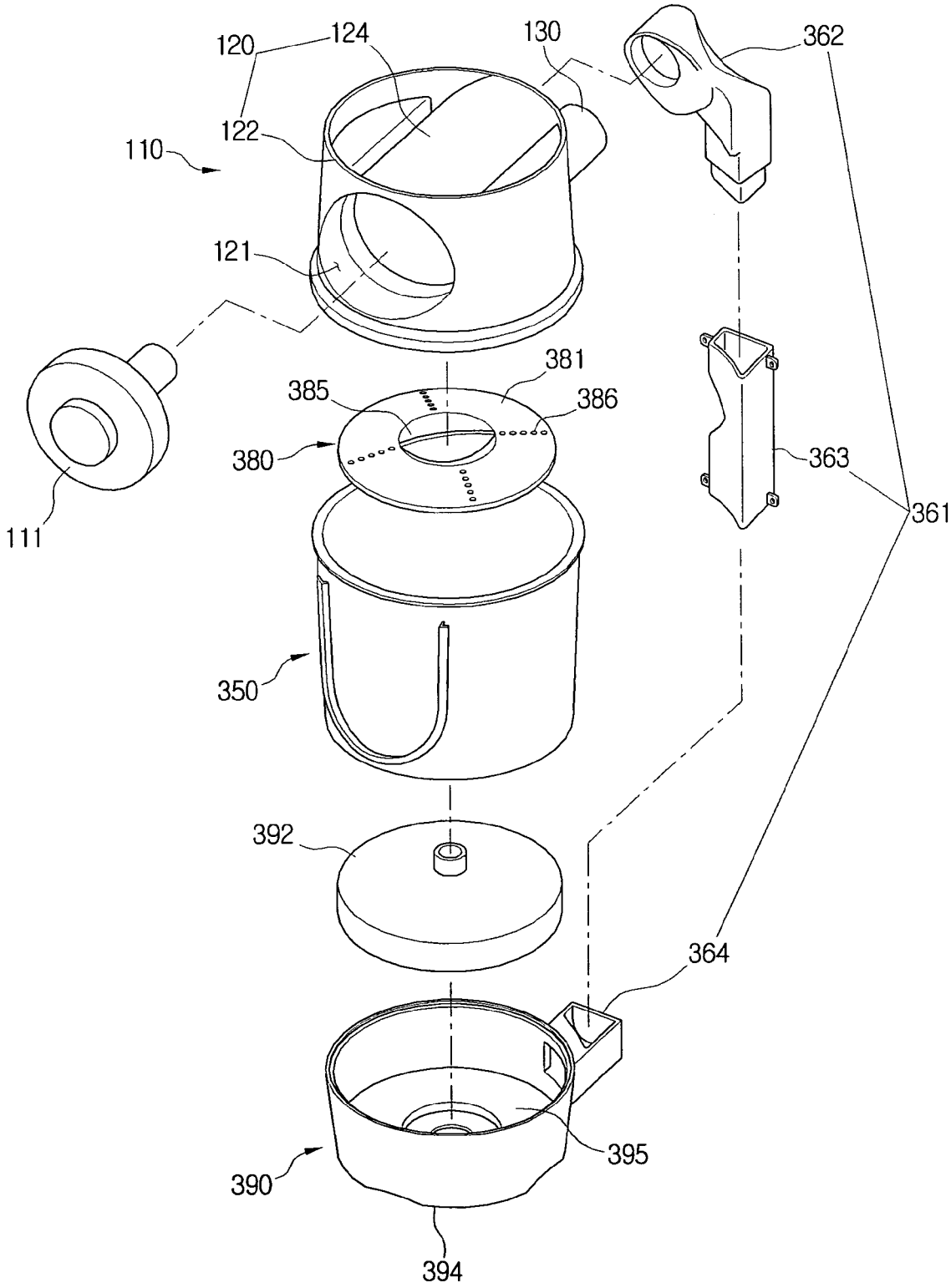
FIG. 9 is an exploded perspective view of the cyclone dust-separating apparatus illustrated in FIG. 8.
Figure 11A:
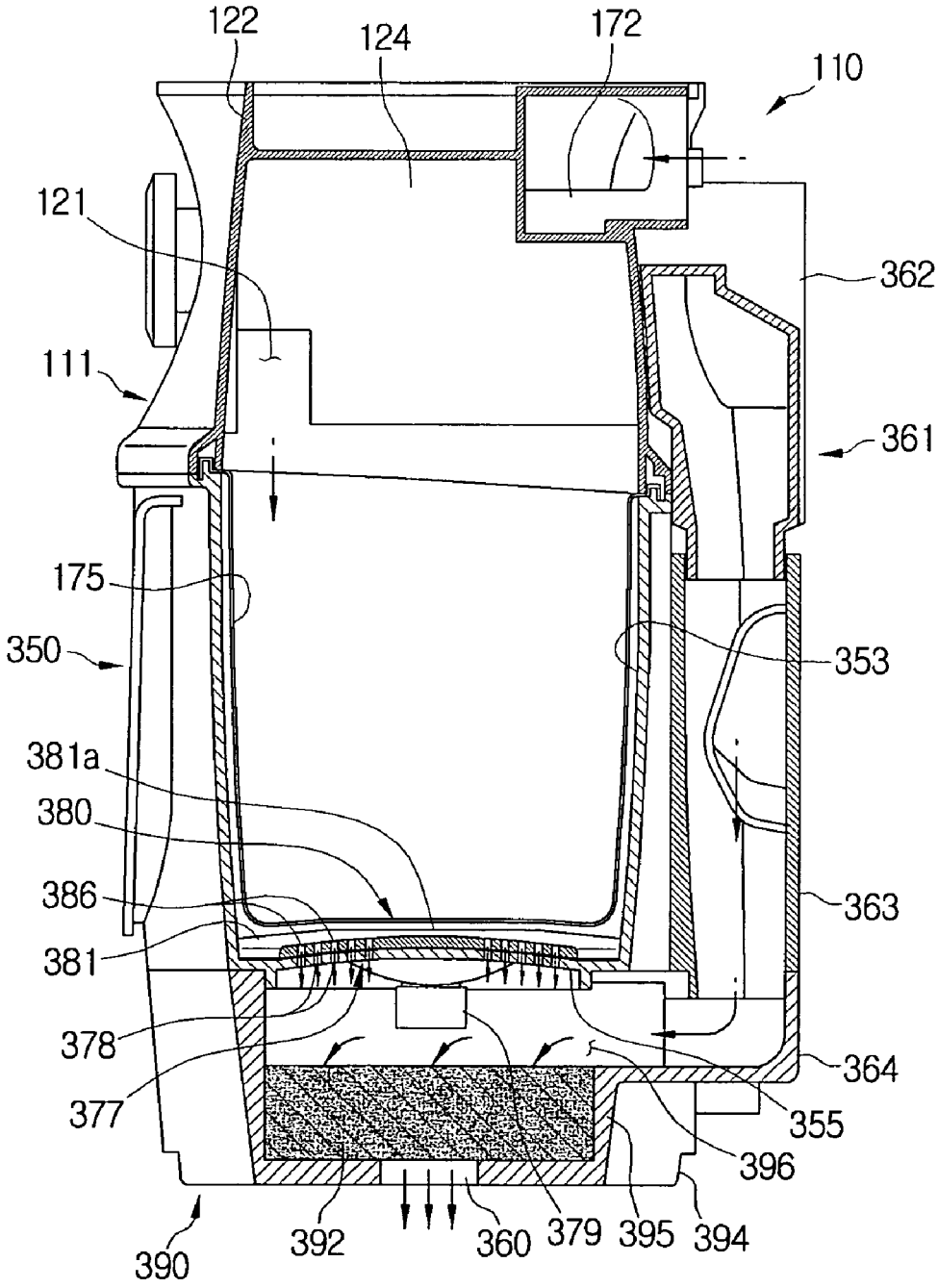
FIGS. 11A and 11B are cross-sectional views exemplifying an operation of a close up-switching part of the cyclone dust-separating apparatus illustrated in FIG. 8.

As illustrated in FIGS. 9 and 11A, the air discharging passage 361 is disposed between the outflow pipe 172 and the filter unit 390, so that air discharged from the outflow pipe 172 of the cyclone unit 110 is flowed into a filter chamber 396 of the filter unit 390 on a bottom part of the dust bin 350 while moving along an outside of the dust bin 350 and discharged from the filter chamber 396. The air discharging passage 361 is made up of first, second and third ducts 362, 363 and 364 respectively. The first duct 362 is installed to surround the outer tub 122 on a side of an outer circumferential surface of the outer tub 122 of the cyclone body 120, and guides the air discharged from the outflow pipe 172 to the second duct 363. The second duct 363 at an upper part thereof is connected to the first duct 362 and extended to a lower part of the dust bin 350 along a side of an outer circumferential surface of the dust bin 350. The second duct 363 guides the air discharged from the first duct 362 to the third duct 364 formed to the filter unit 390. The third duct 364 is formed on a side of an outer circumferential surface of the filter unit 390, and guides the air discharged from the third duct 364 into the filter chamber 396 of the filter unit 390.

As illustrated in FIG. 11A, the pressure difference-generating passage 377 is made up of a plurality of openings 378 formed in a cross-shaped arrangement on a bottom surface 355 of the dust bin 350, so that the dust collecting chamber 353 of the dust bin 350 is directly communicated with the air discharging passage 361 and the filter chamber 396.

To close up the plurality of opens 378 when the nonporous envelope 175 is not used, a close up-switching part 380 is installed on the bottom surface 355 of the dust bin 350 in which the plurality of openings 378 of the pressure difference-generating passage 377 is formed. As illustrated in FIGS. 9 through 11A, the close up-switching part 380 is made up of a rotating plate 381 and a switching knob 385. The rotating plate 381 is rotatably disposed on the bottom surface 355 of the dust bin 350, and has a plurality of homologous openings 386 formed in a cross-shaped arrangement to correspond to the plurality of openings 378. To rotatably support the rotating plate 381 on the bottom surface 355 of the dust bin 350, a center supporting axis (not illustrated) of the rotating plate 381 is connected to a supporting part 379 while penetrating through the bottom surface 355. Also, preferably, but not necessarily, the rotating plate 381 is formed in almost the same size as the bottom surface 355. The switching knob 385, which rotates the rotating plate 381, is formed in the center of an upper surface of the rotating plate 381.

Figure 10A:
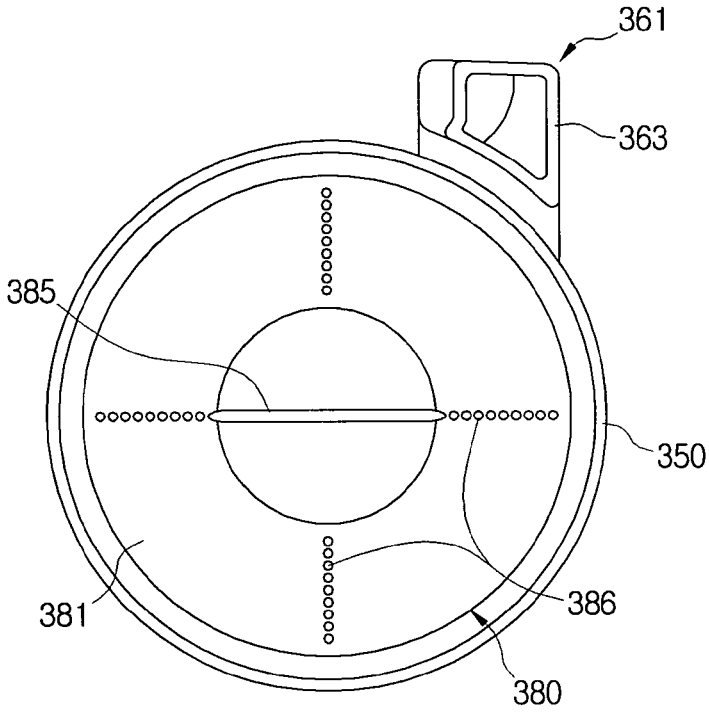
FIGS. 10A and 10B are cross-sectional views of the cyclone dust-separating apparatus taken along line X-X of FIG. 8.

Accordingly, if the nonporous envelope 175 is used, as illustrated in FIGS. 10A and 11A, a user rotates the rotating plate 381 by using the switching knob 385, so that the homologous openings 386 are aligned with the openings 378. As a result, the dust collecting chamber 353 of the dust bin 350 is brought into fluid communication with the air discharging passage 361 and the filter chamber 396 through the openings 378. Thus, when air is drawn into the cyclone dust-separating apparatus 300 by a suction motor (not illustrated) of the vacuum cleaner, a pressure difference is generated between the dust collecting chamber 353 and the filter chamber 396/the air discharging passage 361. At this time, the filter chamber 196 and the air discharging passage 361 have a pressure lower than that of the dust collecting chamber 353. As a result, the nonporous envelope 175 is adhered closely to an inner surface of the dust collecting chamber 353 and an upper surface of the rotating plate 381.

Figure 10B:
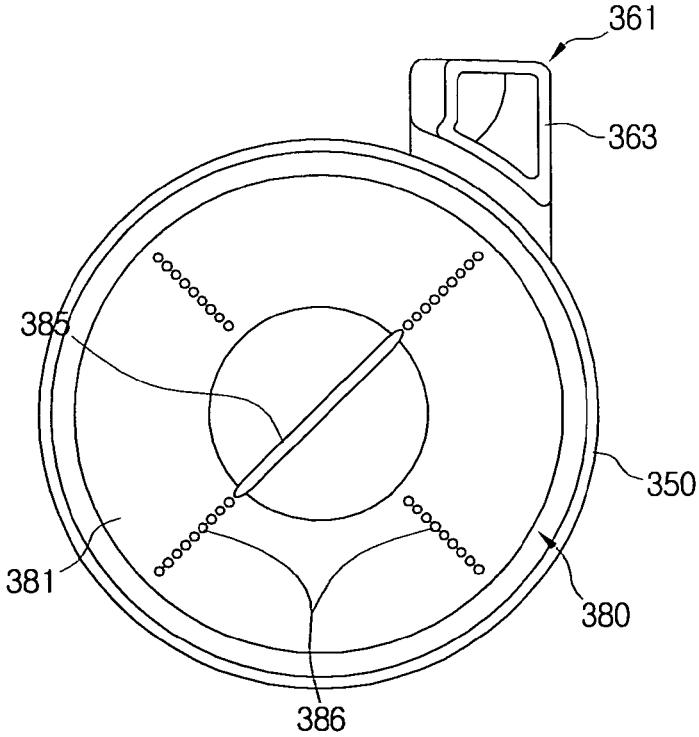
Figure 11B:
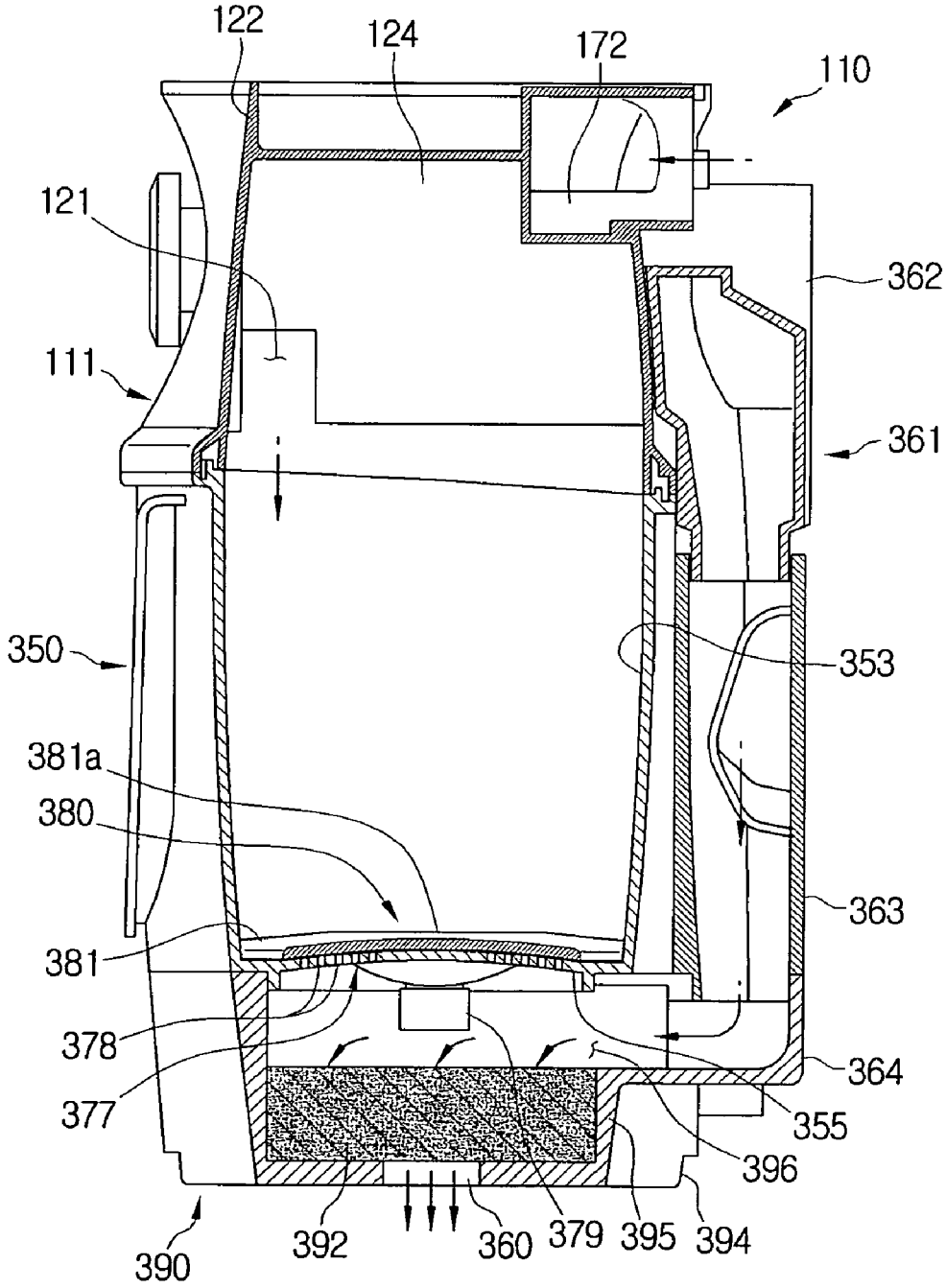

To the contrary, if the nonporous envelope 175 is not used, as illustrated in FIGS. 10B and 11B, the user rotates the rotating plate 381 by an angle of approximately 45° from a position illustrated in FIGS. 10A and 11A by using the switching knob 385, so that the homologous openings 386 is not aligned with the openings 378. Accordingly, the dust collecting chamber 353 of the dust bin 350 is not communicated with the air discharging passage 361 and the filter chamber 396, but isolated therefrom, as in the general cyclone dust-separating apparatus.

To filter dust or dirt included in the air discharged from the cyclone unit 110, the filter unit 390 is joined to a bottom end of the dust bin 350.

The filter unit 390 includes a filter cover 394 and a filter member 392. The filter cover 394 is detachably coupled to the bottom end of the dust bin 350 and forms a filter chamber 396 of predetermined volume therein. The filter cover 394 at a side thereof has a third duct 363 of the air discharging passage 361, which is connected to a lower part of the second duct 363 to draw in air from a second duct 363. In addition, the filter cover 394 at a bottom surface thereof is formed an opening 360 through which the air past the filter member 392 is discharged. The opening 360 is connected directly or indirectly with the suction motor of the vacuum cleaner. The filter member 392 may be formed of a porous filter, such as a sponge or the like, fixed in a filter mount 394 of the filter cover 394.

An operation of the cyclone dust-separating apparatus 300 constructed as described above is the same as that of the cyclone dust-separating apparatus 100 explained with reference to FIGS. 1 and 2, except that the air discharged from the outflow pipe 172 of the cyclone unit 110 is drawn into the filter chamber 396 through the air discharging passage 361 installed on the side of the outer circumferential surface of the dust bin 350 and when the nonporous envelope 175 is not used, the cyclone dust-separating apparatus 300 is operated as in the general cyclone dust-separating apparatus to which the nonporous envelope 175 is not applied by closing up the openings 378 of the pressure difference-generating passage 377, as illustrated in FIGS. 10B and 11B. Accordingly, a detailed description on the operation of the cyclone dust-separating apparatus 300 will be omitted for clarity and conciseness.

As apparent from the foregoing description, according to the exemplary embodiments of the present disclosure, the cyclone dust-separating apparatus is configured, so that the cyclone unit is installed to have the longitudinal axis horizontally arranged and the height of the dust bin is increased. Accordingly, the cyclone dust-separating apparatus according to the exemplary embodiments of the present disclosure can increase the capacity of the dust bin, thereby improving the convenience in use.

Further, the cyclone dust-separating apparatus according to the exemplary embodiments of the present disclosure has the horizontal cyclone unit and the vertical dust bin. Accordingly, because the air stream whirling in the cyclone unit is not spread to the inside of the dust bin, the dust or dirt stored in the dust bin is prevented from flowing backward to the cyclone unit again.

Furthermore, the cyclone dust-separating apparatus according to the exemplary embodiments of the present disclosure is configured so that for a user to empty the dust bin of the dust or dirt collected therein, only the nonporous envelope is separated from the dust bin and dumped. Accordingly, the scattering of the dust or dirt and/or the contamination of circumference according thereto are prevented.

Further, the cyclone dust-separating apparatus according to the exemplary embodiments of the present disclosure is configured, so that the guide unit is removably mounted on the cyclone body. Accordingly, the cyclone dust-separating apparatus according to the exemplary embodiments of the present disclosure has a cyclone unit with a conveniently-cleanable filter and inside.

Moreover, the cyclone dust-separating apparatus according to the exemplary embodiments of the present disclosure is configured so that the guide pipe extends into the cyclone unit from the guide unit by a predetermined length. Accordingly, the cyclone dust-separating apparatus according to the exemplary embodiments of the present disclosure allows the whirling air stream formed in the cyclone chamber to retain the rotating force without being dispersed.

In addition, the cyclone dust-separating apparatus according to the exemplary embodiments of the present disclosure is configured so that the air discharging passage discharging the air from the cyclone unit passes through the dust bin, thereby reducing the piping loss of the discharged air.

Also, the cyclone dust-separating apparatus according to the exemplary embodiments of the present disclosure is configured, so that the cyclone unit first separates the dust or dirt from the air and the filter unit filters the fine dust laden in the air once again, thereby improving the dust-separating efficiency.

Although representative embodiments of the present disclosure have been shown and described in order to exemplify the principle of the present disclosure, the present disclosure is not limited to the specific embodiments. It will be understood that various modifications and changes can be made by one skilled in the art without departing from the spirit and scope of the invention as defined by the appended claims. Therefore, it shall be considered that such modifications, changes and equivalents thereof are all included within the scope of the present disclosure.

What is claimed is:

1. A cyclone dust-separating apparatus comprising:

a cyclone unit having an air inflow part and an air outflow part so as to separate dust or dirt from air, the cyclone unit being installed in such a manner that a longitudinal axis thereof is substantially horizontally arranged;

a dust bin joined to a bottom end of the cyclone unit so as to collect the dust or dirt separated by the cyclone unit, the dust bin being installed in such a manner that a longitudinal axis thereof is substantially perpendicular to the longitudinal axis of the cyclone unit;

a nonporous envelope detachably disposed in the dust bin so as to store the dust or dirt collected into the dust bin; and a pressure difference-generating passage to communicate an outlet of the air outflow part and the dust bin with each other so as to allow the nonporous envelope to come in contact with an inner surface of the dust bin by a pressure difference between the dust bin and the air outflow part.

2. The apparatus as claimed in claim 1, wherein the dust bin comprises an air discharging passage connected with the air outflow part, so that the air discharged from the cyclone unit penetrates through the dust bin and discharges in a direction toward a bottom end of the dust bin.

3. The apparatus as claimed in claim 2, wherein the pressure difference-generating passage comprises a plurality of openings formed in the dust bin so as to allow the dust bin to communicate with the air discharging passage.

4. The apparatus as claimed in claim 3, wherein the air discharging passage is disposed to penetrate through a dust bin chamber of the dust bin in upward and downward directions.

5. The apparatus as claimed in claim 4, wherein the air discharging passage is formed on one side of the dust bin chamber, and wherein the air discharging passage has a width that gradually increases between an upper and a lower part of the air discharging passage.

6. The apparatus as claimed in claim 5, further comprising a filter unit joined to the bottom end of the dust bin so as to filter dust or dirt included in the air discharged through the air discharging passage from the cyclone unit.

7. The apparatus as claimed in claim 6, wherein the filter unit comprises:

a filter cover joined to the bottom end of the dust bin to form a filter chamber having a predetermined volume; and a filter member disposed in the filter chamber.

8. The apparatus as claimed in claim 7, wherein the filter member comprises a pleated cylindrical filter, an upper part of which is substantially impedes airflow therethrough.

9. The apparatus as claimed in claim 1, wherein the dust bin comprises:

an outer tub; and an inner tub disposed in a spaced-apart relation to the outer tub so as to form an air flowing space between the outer tub and the inner tub, the inner tube at an upper part thereof being joined with the outer tub.

10. The apparatus as claimed in claim 9, wherein the pressure difference-generating passage comprises:

a subsidiary passage disposed between the air outflow part of the cyclone unit and the outer tub so as to place the air outflow part and the air flowing space in fluid communication; and a plurality of openings formed in the inner tub of the dust bin so as to place the inner tub of the dust bin, the subsidiary passage, and the air flowing space in fluid communication.

11. The apparatus as claimed in claim 1, further comprising an air discharging passage connected with the air outflow part, so that the air discharged from the cyclone unit is flowed in a direction toward a bottom end of the dust bin along an outside of the dust bin and then discharged.

12. The apparatus as claimed in claim 11, wherein the pressure difference-generating passage comprises a plurality of openings formed in the dust bin so as to place the dust bin and the air discharging passage in fluid communication.

13. The apparatus as claimed in claim 12, wherein a close up-switching part is disposed to the pressure difference-generating passage so as to close up the plurality of openings when the nonporous envelope is not used.

14. The apparatus as claimed in claim 13, wherein the close up-switching part comprises:

a plate rotatably disposed to the dust bin and having a plurality of homologous openings corresponding to the plurality of openings; and a handle formed on the rotating plate.

15. The apparatus as claimed in claim 14, further comprising a filter unit joined to the bottom end of the dust bin so as to filter dust or dirt included in the air discharged through the air discharging passage from the cyclone unit.

16. The apparatus as claimed in claim 15, wherein the filter unit comprises:

a filter cover joined to the bottom end of the dust bin to form a filter chamber in a predetermined volume; and a filter member disposed in the filter chamber.

17. The apparatus as claimed in claim 16, wherein the filter member comprises a porous filter fixed on a filter mount of the filter cover.

* * * * *